US005335851A

United States Patent [19]

Adaska et al.

[11] Patent Number: 5,335,851

[45] Date of Patent: Aug. 9, 1994

[54] DRINKING STRAW FOR RUNNERS

[76] Inventors: Jerry Adaska, 1954 - 18th St., Cuyahoga Falls, Ohio 44223; Don L. Robart, 2223 Hoch Dr., Cuyahoga Falls, Ohio 44221

[21] Appl. No.: 950,407

[22] Filed: Sep. 23, 1992

[51] Int. Cl.[5] ..... A47G 21/18

[52] U.S. Cl. ..... 239/33

[58] Field of Search ..... 239/16, 24, 33; 433/6; 128/861

[56] References Cited

U.S. PATENT DOCUMENTS

| | | | |
|---|---|---|---|
| 2,815,981 | 12/1957 | Nonnamaker et al. | 239/33 |
| 3,409,224 | 11/1968 | Harp et al. | 239/33 |
| 4,340,175 | 7/1982 | Danek et al. | 239/33 |
| 5,165,423 | 11/1992 | Fowler et al. | 128/861 |

FOREIGN PATENT DOCUMENTS

| | | | |
|---|---|---|---|
| 1051644 | 1/1954 | France | 239/33 |

*Primary Examiner*—Andres Kashnikow
*Assistant Examiner*—William Grant
*Attorney, Agent, or Firm*—Oldham, Oldham & Wilson Co.

[57] ABSTRACT

The invention described herein pertains generally to an improved design over conventional drinking straws and is particularly suitable for individuals, such as runners, who need to intake liquid refreshment while in motion. In particular, a polymeric drinking straw is described which has an elongated cylinder having a proximal end for insertion into a user's mouth and a distal end for insertion into a consumable fluid within a container, a generally oval mouthpiece affixed about a periphery of the proximal end of the straw, the mouthpiece having apertures about the periphery of the mouthpiece to permit a user to selectively breath through the apertures or drink through the straw, an optional accordion-like pleat positioned between the proximal and distal ends of the straw to permit bending of the straw, at least one side aperture in a wall of the cylinder, the aperture positioned in close proximity to the distal end of the cylinder, the function of the side aperture being to prevent the straw from forming a seal against a bottom of the container, and an optional clip at the distal end of the cylinder to allow the user to attach the straw to an article of clothing of the user.

6 Claims, 2 Drawing Sheets

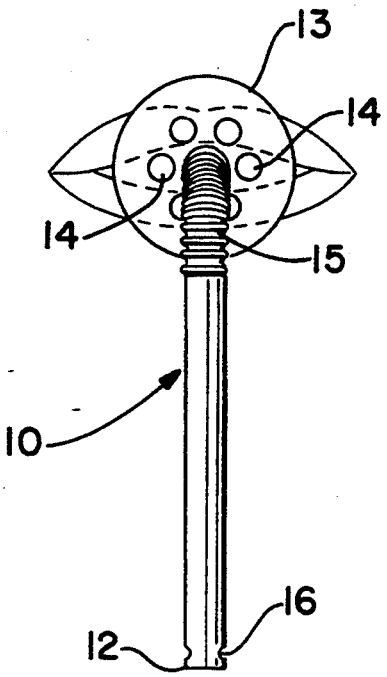
FIG.-2b
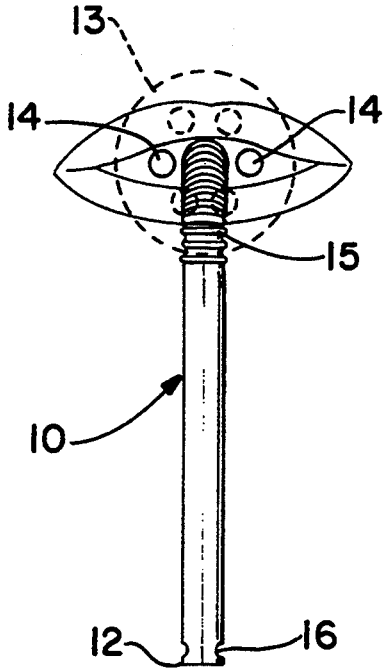
FIG.-3b
FIG.-3a
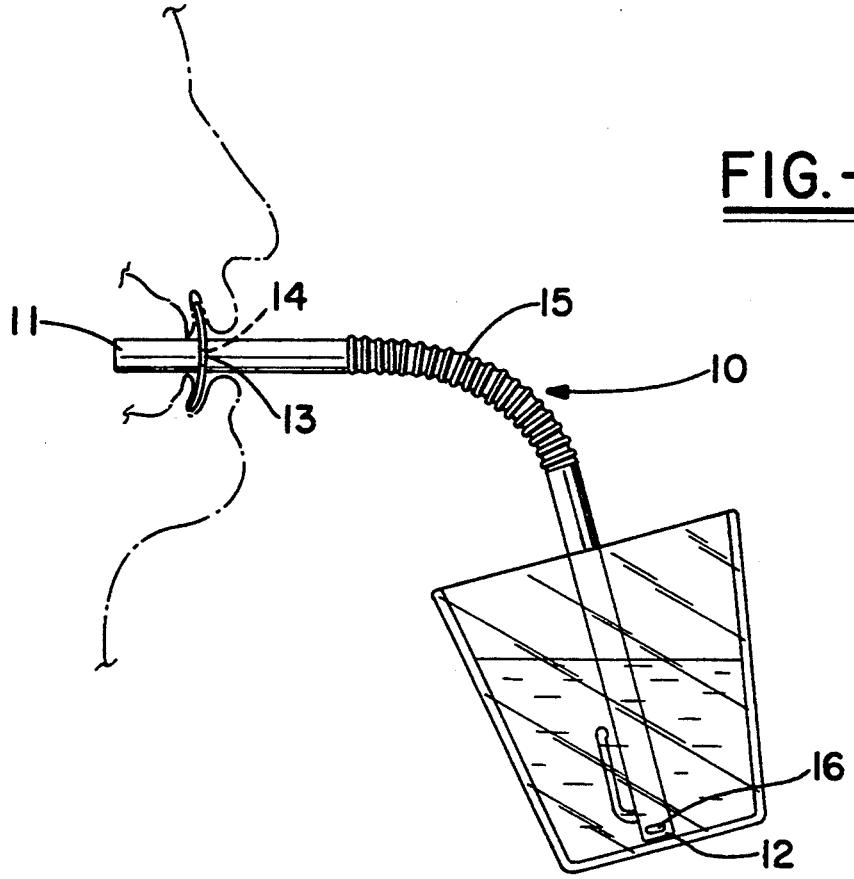

DRINKING STRAW FOR RUNNERS

TECHNICAL FIELD

The invention described herein pertains generally to an improved design over conventional drinking straws and is particularly suitable for individuals, such as runners, who need to intake liquid refreshment while in motion.

BACKGROUND OF THE INVENTION

During strenuous physical activity, such as running races, and especially those involving distance races of 10 kilometers or more, a runner's body can become dehydrated, unless the lost fluid is replaced. During such exercise, particularly in heat, a great metabolic demand is placed on the human body. During such exercise, sweat is lost from the body, which can produce a state of dehydration or hypohydration. Dehydration, is associated with a reduction in the plasma volume in a cell. Associated with dehydration is an impairment of body heat dissipation and endurance performance. To maintain the body's physical capabilities, it is essential that water, electrolytes, carbohydrate, and other nutrients be provided in a timely and appropriate manner. Fluid replacement during physical activity has been shown to be effective in preventing dehydration and hyperthermia.

In marathon races, there may be as many as twenty (20) fluid, water, replenishing stations spaced at convenient intervals throughout the race course. These stations are typically manned by individuals who hand out plastic or paper liquid containers containing water or other suitable fluids. As the runner passes these water stations, he attempts to maintain his pace by maintaining his or her stride, breathing rhythm and air intake volume. As the runner takes the container and attempts to drink, a majority of the fluid is spilled. If the liquid contains fruit sugars or electrolytes, the runner's skin and clothes become encrusted with sticky and crystalline residue which causes discomfort and reduces concentration and efficiency by skin chafing and irritation.

Runners also frequently choke when attempting to drink from a conventional cup container. Some runners have resorted to carrying a plastic straw with them which they carry in their shorts or behind their ear. This tends to reduce spillage, however, the straw may form a seal on the bottom of the cup causing liquid intake to stop momentarily and causing the runner to disrupt his breathing pattern, or it may poke the back of the throat of the runner. The straw is also easily lost. To date, there has been no effective device which will permit a runner to intake fluid without breaking stride or spilling large quantities of liquid during the intake process.

SUMMARY OF THE INVENTION

In accordance with the present invention, there is provided a drinking straw containing one or more openings at the distal end of the straw to prevent flow impediment caused by the circular intake end of a conventional straw contacting the bottom of the cup and forming a seal.

It is another object of this invention to provide a drinking straw provided with a perforated oval-shaped mouthpiece located a few centimeters from the proximal end of the straw and designed to assist the runner in maintaining the position of the straw in his mouth and at the same time allowing the passage of air through the perforated part and subsequently into the runner's mouth.

It is still another object of this invention to provide a straw with a curved or bendable accordion section midway between the mouth piece and the distal end to allow the straw to bend at any angle desired by the user.

It is yet another object of this invention to provide a drinking straw equipped with a fastening device which will allow it to be attached to a user's clothing or body.

It is still a further object of this invention to provide a drinking straw which is made of a printable and sterilizable polymer.

It is yet another object of this invention to provide a drinking straw which can be injection molded as a unitary product.

These and other objects of this invention will be evident when viewed in light of the drawings, detailed description, and appended claims.

DETAILED DESCRIPTION OF THE DRAWINGS

Figure 1:
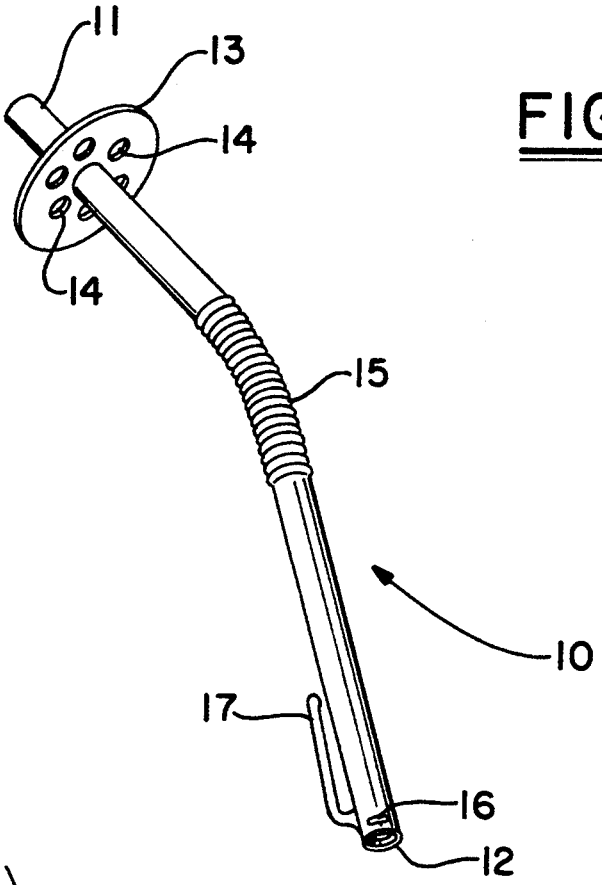
Figure 2A:
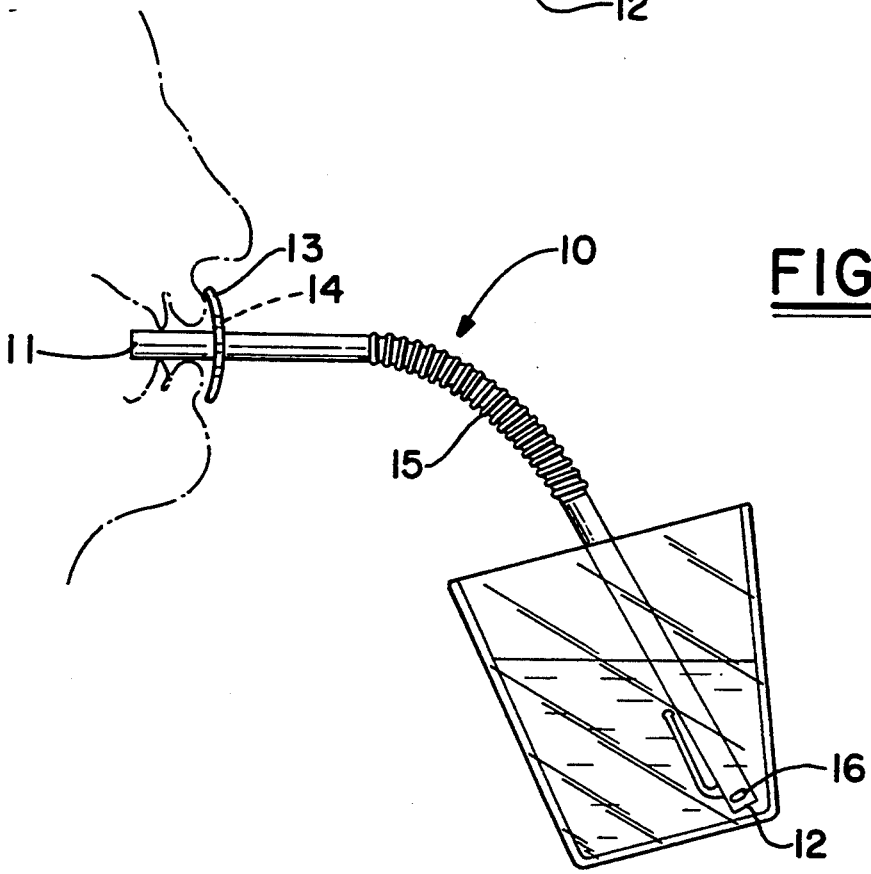

The invention may take physical form in certain parts and arrangements of parts, a preferred embodiment of which will be described in detail in the specification and illustrated in the accompanying drawings which form a part hereof, and wherein:

FIG. 1 is a perspective view of the drinking straw;

FIG. 2*a* is a side view of the drinking straw held between the teeth with the mouthpiece positioned outside of the lips;

FIG. 2*b* is a front view of the drinking straw as shown in FIG. 2*a;*

FIG. 3*a* is a side view of the drinking straw held between the teeth with the mouthpiece positioned between the teeth and lips; and FIG. 3*b* is a front view of the drinking straw as shown in FIG. 3*a.*

DETAILED DESCRIPTION OF THE INVENTION

Referring now to the drawings wherein the showings are for purposes of illustrating the preferred embodiment of the invention only and not for purposes of limiting the same, the Figures show a drinking straw particularly suitable for individuals, such as runners, who need to intake liquid refreshment while in motion.

As illustrated in FIG. 1, the drinking straw 10 is an elongated generally cylindrical plastic straw with a proximal end 11 which is adapted for insertion into the mouth and a distal end 12 which is immersed into the drinking fluid. Spaced at an appropriate distance from proximal end 11 (typically 2–3 centimeters), is mouthpiece 13 containing several apertures 14 disposed about a periphery of mouthpiece 13. Mouthpiece is generally of a circular nature, although other shapes, such as an oval shape are contemplated within the scope of the invention.

The apertures 14 within mouthpiece 13 are designed to permit the passage of air into a runner's throat and lungs without removing the straw from the mouth. This configuration maximizes a runner's ability to time his fluid intake during the race. Additionally, the ability to maintain breathing while straw 10 is positioned within the mouth, permits the runner to selectively intake measured quantities of fluids during any one sip, thereby not requiring any "gulping" which tends to increase the amount of air carried into the stomach cavity causing discomfort to the runner.

In one embodiment of the invention, at a point between mouthpiece 13 and distal end 12, an optional accordion-like pleat 15 is included thereby allowing the straw to flex or bend in this region. The stiffness of the material of construction is regulated by the thickness and/or composition of the straw wall, thereby permitting the user to selectively choose to maintain a fixed angle or a continuously adjustable angle as the force of gravity or other imposed forces are applied.

At distal end 12 of straw 10, at least one, but preferably several, side apertures 16 are positioned in close proximity to the distal end. These apertures or notches are to prevent the straw from forming a seal against the flat surface of the drinking cup which would inhibit the flow of liquid. Optionally, a clip 17 can be fastened at distal end 12 to allow the straw to be attached to the clothing of the user.

As shown in FIGS. *2a* and *2b*, in one mode of usage, mouthpiece 13 of straw 10 is positioned immediately adjacent to the exterior of a user's lips with proximal end 11 being grasped by the user's teeth. Distal end 12 of straw 10 is positioned inside of the container holding the desired fluid. FIGS. *3a* and *3b* illustrate a second mode of usage of the straw wherein mouthpiece 13 of straw 10 is positioned between the teeth and lips of the user during usage.

In a typical race, a runner clips the drinking straw 10 to his clothing via optional clip 17. During the race, as the runner approaches the water station, he unclips drinking straw 10 and places the proximal end 11 into his mouth with mouthpiece 13 either inside or outside of his lips. The drinking straw is held in place between the teeth. Depending upon the stiffness of the straw, it is either bent to the desired angle or allowed to bend under an applied force. In one embodiment of the invention, the straw is already pre-bent to a predetermined angle. As the runner passes the water station, he takes the fluid-containing cup and while holding it in a relatively horizontal position to reduce spillage, he raises the cup until the straw is immersed in the liquid. He can then drink the liquid between breaths or drink portions of the liquid between several breaths. The apertures 14 in mouthpiece 13 allow the runner to breath through his mouth as well as his nose between swallows, thereby allowing maximum volume of air intake.

The material of preference for the straw manufacture is typically polymeric in nature and depending upon the degree of flexibility desired, can contain varying amounts of rubbery segments within the polymer. The polymer is generally of synthetic origin and can be classified by thermal behavior, chemical nature or by molecular structure. When classified by temperature characteristics, the main categories include thermoplastic elastomers such as nylon, polyvinyl chloride, polyolefin (e.g. polyethylene, polypropylene, etc.), polystyrene, fluorocarbon resins, acrylate resins, etc. and thermosetting elastomers including phenolics, alkyds, polyesters, etc. When chemical nature is used to distinguish the polymer, categories of resins such as amino, alkyd, acrylic, vinyl, phenolic, epoxy, urethane, etc. are applicable. And when molecular structure is applicable, atactic, syndiotactic, isotactic, linear, crosslinked, block, graft, ladder, etc. are used. The synthetic resins include a wide variety of materials having properties ranging from hard and brittle to soft and elastic. The addition of such modifying agents such as fillers, colorants, etc., yields an almost infinite number of products collectively called plastics.

The invention has been described with reference to preferred and alternate embodiments. Obviously, modifications and alterations will occur to others upon the reading and understanding of the specification. It is intended to include all such modifications and alterations insofar as they come within the scope of the appended claims or the equivalents thereof.

What is claimed is:

1. A drinking straw comprising:

(a) an elongate cylinder having a proximal end for insertion into a user's mouth and a distal end for insertion into a consumable fluid within a container, said cylinder further having at least one side aperture through the cylinder positioned in close proximity to the distal end thereof, for preventing the cylinder distal end from sealing against the container bottom, and said cylinder having a clip at the distal end thereof to allow the user to attach the straw to an article of clothing; and (b) a mouthpiece affixed about a periphery of said proximal end, the mouthpiece having at least one aperture disposed therethrough to permit the user to selectively breathe through said at least one mouthpiece aperture or to drink through the cylinder.

2. The drinking straw of claim 1 wherein the mouthpiece is generally circular in shape.

3. The drinking straw of claim 1 wherein the cylinder is a polymer.

4. The drinking straw of claim 1 wherein the cylinder is bendable.

5. The drinking straw of claim 4 wherein the cylinder is sterilizable.

6. A polymeric drinking straw comprising:

(a) an elongated cylinder having a proximal end for insertion into a user's mouth and a distal end for insertion into a consumable fluid within a container;

(b) a generally circular mouthpiece affixed about a periphery of the proximal end of the straw, a periphery of the mouthpiece having a plurality of apertures disposed therethrough to permit a user to selectively breathe through the apertures or drink through the straw;

(c) a series of circumferential grooves effectively forming an accordion shaped pleat positioned between the proximal and distal ends of the cylinder to permit bending of the cylinder;

(d) at least one side aperture in a wall of the cylinder positioned in close proximity to the distal end of the cylinder, the side aperture preventing the straw from forming a seal against a bottom of the container; and (e) a clip at the distal end of the cylinder to allow the user to attach the straw to an article of clothing of the user.

* * * * *